US009683745B2

(12) United States Patent
Lehet

(10) Patent No.: US 9,683,745 B2
(45) Date of Patent: Jun. 20, 2017

(54) SMALL, HIGH EFFICIENT WOOD STOVE

(71) Applicant: Roger Lehet, Vashon, WA (US)

(72) Inventor: Roger Lehet, Vashon, WA (US)

( * ) Notice: Subject to any disclaimer, the term of this patent is extended or adjusted under 35 U.S.C. 154(b) by 31 days.

(21) Appl. No.: 14/231,653

(22) Filed: Mar. 31, 2014

(65) Prior Publication Data

US 2015/0345797 A1 Dec. 3, 2015

Related U.S. Application Data

(60) Provisional application No. 61/806,521, filed on Mar. 29, 2013.

(51) Int. Cl.

| | |
|---|---|
| ***F23N 3/00*** | (2006.01) |
| ***F24B 1/02*** | (2006.01) |
| ***F23L 13/06*** | (2006.01) |
| ***F23B 60/02*** | (2006.01) |
| ***F23B 90/04*** | (2011.01) |
| ***F23B 10/02*** | (2011.01) |
| *F24B 13/00* | (2006.01) |
| *F24B 1/20* | (2006.01) |

(52) U.S. Cl.

CPC ..... *F24B 1/026* (2013.01); *F23B 10/02* (2013.01); *F23B 60/02* (2013.01); *F23B 90/04* (2013.01); *F23L 13/06* (2013.01); *F23N 3/007* (2013.01); *F23N 2035/06* (2013.01); *F24B 1/202* (2013.01); *F24B 13/004* (2013.01); *F24B 13/008* (2013.01)

(58) Field of Classification Search

USPC ..... 126/77, 58, 15 R, 25 R

See application file for complete search history.

(56) References Cited

U.S. PATENT DOCUMENTS

| | | | | |
|---|---|---|---|---|
| 4,484,530 A * | 11/1984 | Goetzman | F23B 5/04 | 110/118 |
| 4,630,553 A * | 12/1986 | Goetzman | F23B 5/04 | 110/214 |
| 4,691,686 A * | 9/1987 | Alvarez | F24B 1/028 | 110/203 |
| RE33,077 E * | 10/1989 | Van Dewoestine | F23B 5/00 | 110/203 |
| 6,615,821 B1 * | 9/2003 | Fisenko | A47J 37/0704 | 126/15 R |
| 8,230,848 B2 * | 7/2012 | Fou | A47J 37/07 | 126/25 R |

* cited by examiner

*Primary Examiner* — Avinash Savani

(74) *Attorney, Agent, or Firm* — Dean A. Craine, P.S

(57) ABSTRACT

A wood stove that includes a hollow cylindrical outer skin with an coaxially aligned, insulated inner fire box. Located below the fire box is a fresh air inlet and an air control valve that controls the flow of fresh air into the stove's primary and secondary chambers. Surrounding the fire box are three longitudinally aligned air conduits that extend from the air inlet to an upper ledge located below a secondary combustion chamber. During use, the fresh air inside the air conduits is heated. Disposed transversely inside the outer jacket and above the primary chamber is a combustor assembly that includes a lower fin plate, a perforated intermediate plate and a perforated upper plate. During use, fuel is added to the fire box which undergoes initial combustion and produces hot gases and fumes that travel upward towards the chamber assembly. The air control valve controls flow of fresh air into the primary chamber only, both chambers, or into only the secondary chamber.

9 Claims, 9 Drawing Sheets

SMALL, HIGH EFFICIENT WOOD STOVE

This utility patent application is based on and claims the filing date benefit of U.S. provisional patent application (Application No. 61/806,521) filed on Mar. 29, 2013

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to wood burning stoves and furnaces, and more particularly to small, free-standing, high efficiency wood stoves designed to heat small areas for long periods.

2. Description of the Related Art

Wood burning stoves for structures with small living areas, such as boats, trailers or cabins must be compact and safe. Because of their small size, they can only burn small amounts of fuel at one time and must be highly efficient.

Large free-standing wood stoves use large primary combustion chambers that enable them to burn larger pieces of wood and produce more heat. The efficiency of a stove, regardless of its size, is determined by the combustion that occurs inside the stove and the heat transfer. While ideally the combustion and amount of heat transfer should be near 100%, no stove burns wood at these high efficiencies.

Complete combustion occurs inside a wood stove when an adequate amount of oxygen enters the stove so all of the carbon atoms and water molecules in the wood are converted to CO2 and released into the stove pipe. Heat transfer is 100% when all of the heat from combustion is transferred to the air and objects surrounding the stove.

In order for maximize combustion in a wood stove, an optimal volume of oxygen must be delivered to specific regions in the stove's combustion chamber. If too much oxygen is delivered or if it is delivered to the wrong region in the combustion chamber, combustion is incomplete. Ideally, a sufficient volume of oxygen should be delivered to the combustion chamber so it swirls forcibly around inside the combustion chamber and mixes with the combustion gases.

The heat transfer efficiency of a wood stove is dependent in part on the stove's structure, where high temperatures and greater turbulence of the gases occur inside the stove, and the exposure or residence time of the gases inside the stove and stove pipe. Higher temperatures, greater the turbulence, and slower movement of the gases through the stove, generate more heat transfer. Factors that control the velocity or movement of the gases through a stove include the design of the fire box and secondary structures inside the stove such as baffles, the size and shape of the stove pipe, and the height of the stove pipe that impede movement of the hot gases out of the stove.

SUMMARY OF THE INVENTION

Disclosed herein is a compact stove designed to undergo greater combustion of fuel by using a primary combustion chamber where partial combustion occurs and a secondary combustion chamber located above the primary combustion chamber where substantially total combustion occurs. Three key features of the invention are: (1) the creation of two combustion chambers; (2) impeding the rate of combustion in each chamber by controlling the amount of fresh air into the two chambers; and (3) restriction of the flow of hot gas and fumes from the primary combustion chamber air into the secondary combustion chamber.

A portable, high efficiency wood stove that includes a hollow cylindrical outer skin with an coaxially aligned, insulated inner fire box. Located below the fire box is a fresh air inlet and an air control valve that controls the flow of fresh air into the stove's primary and secondary chambers. The fire box is shorter than the outer jacket thereby creating a flat upper ledge that demarks the beginning of the secondary combustion chamber. Surrounding the fire box are three longitudinally aligned air conduits that extend from the fresh air inlet to the upper ledge. During use, the fresh air inside the air conduits is heated. Disposed transversely inside the outer jacket and supported by the upper ledge is a combustor assembly that includes a lower fin plate, a perforated intermediate plate and a perforated upper plate. During use, fuel is added to the fire box which undergoes initial combustion and produces hot gases and fumes that travel upward towards the combustor assembly. The air control valve is manipulated to control the flow of fresh either into the primary chamber only, both chambers, or only the secondary chamber.

The fire box includes a lower opening in which a grate and ash pan cover is removably disposed. Located below the fire box is a lower air cavity in which fresh air enters. In the embodiment shown herein, a removable ash tray slides into the lower air cavity.

The stove includes a lower adjustable fresh air valve which allows the operator to finely adjust the amount of fresh air that enters the primary chamber and the secondary chamber. In the embodiment shown herein, the fresh air valve includes a rotating damper plate with a plurality of primary and secondary holes formed therein. During use, the damper plate is rotated to open or close the primary and secondary holes to control the flow of fresh air into the primary chamber only, into both the primary and secondary chambers, or only into the secondary chamber.

In the preferred embodiment, the combustor assembly includes three stacked plates, a lower fin plate, a middle perforated plate and a upper perforated plate. The lower plate includes plurality of radially aligned, downward extending fins with adjacent triangular shaped openings. The middle and upper plates are stacked above and separated by spacers and each include a plurality of holes that are offset so the mixture of hot gases and fumes and the fresh air thoroughly mix and flows slowly into the secondary combustion chamber.

DESCRIPTION OF THE PREFERRED EMBODIMENT(S)

Figure 1:
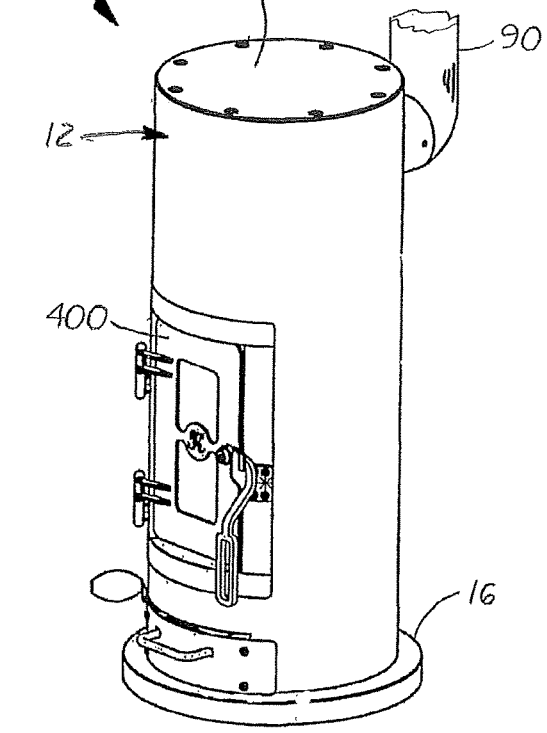
FIG. 1 is a perspective view of the small, high efficiency wood stove.
Figure 2:
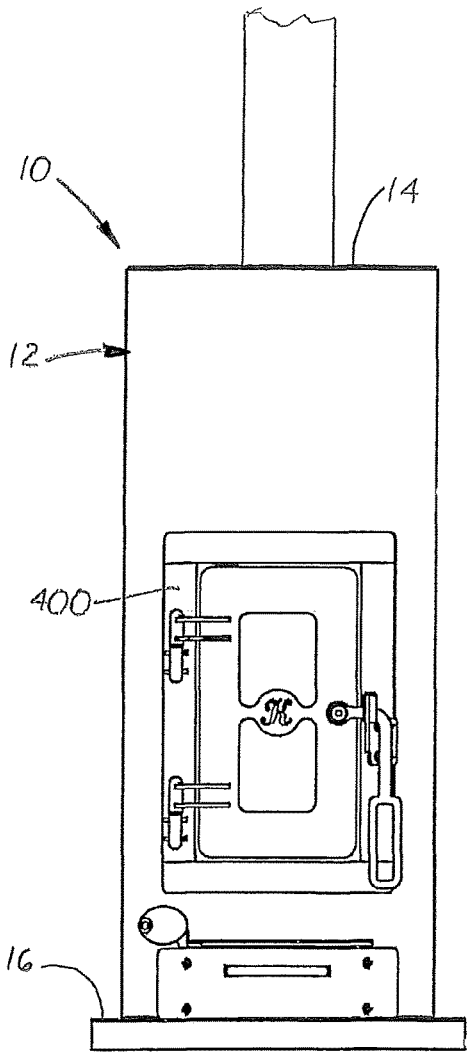
FIG. 2 is a front elevational view of the wood stove.
Figure 3:
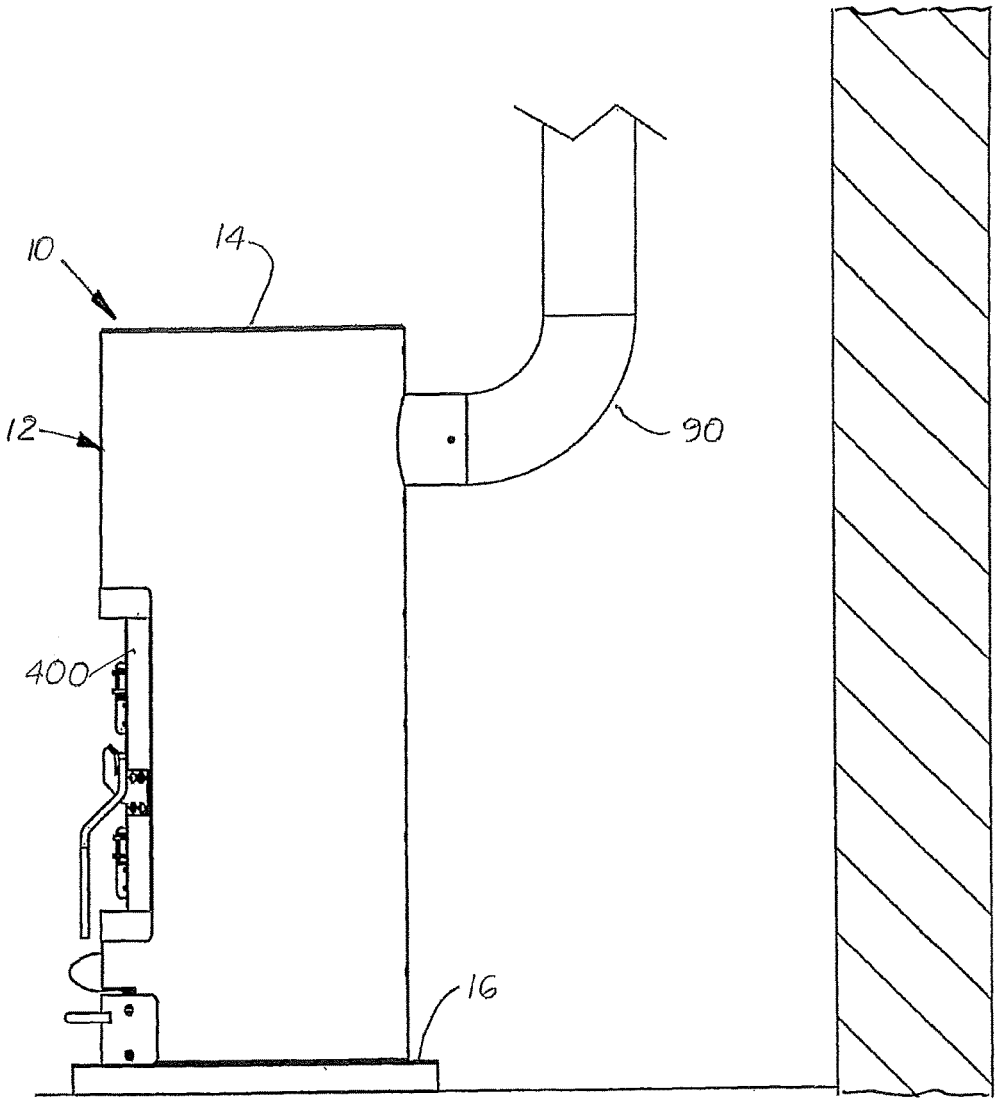
FIG. 3 is a side elevational view of the wood stove.
Figure 4:
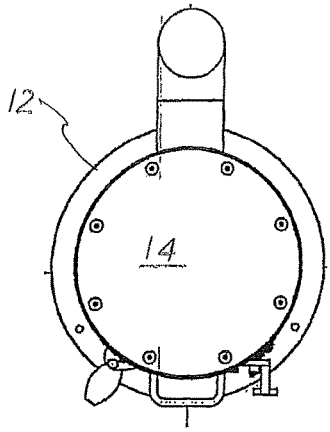
FIG. 4 is a top plan view of the wood stove.

Referring to the accompanying FIGS. 1-12, there is shown a small, portable, high efficiency wood stove 10 that includes a cylindrical outer skin 12 with a continuous inner bore. The outer skin 12 includes a flat top plate 14 and a flat bottom base 16. The edges of the outer skin 12 may be held with an optional spine 18 that extends longitudinally inside the wood stove 10.

Figure 6:
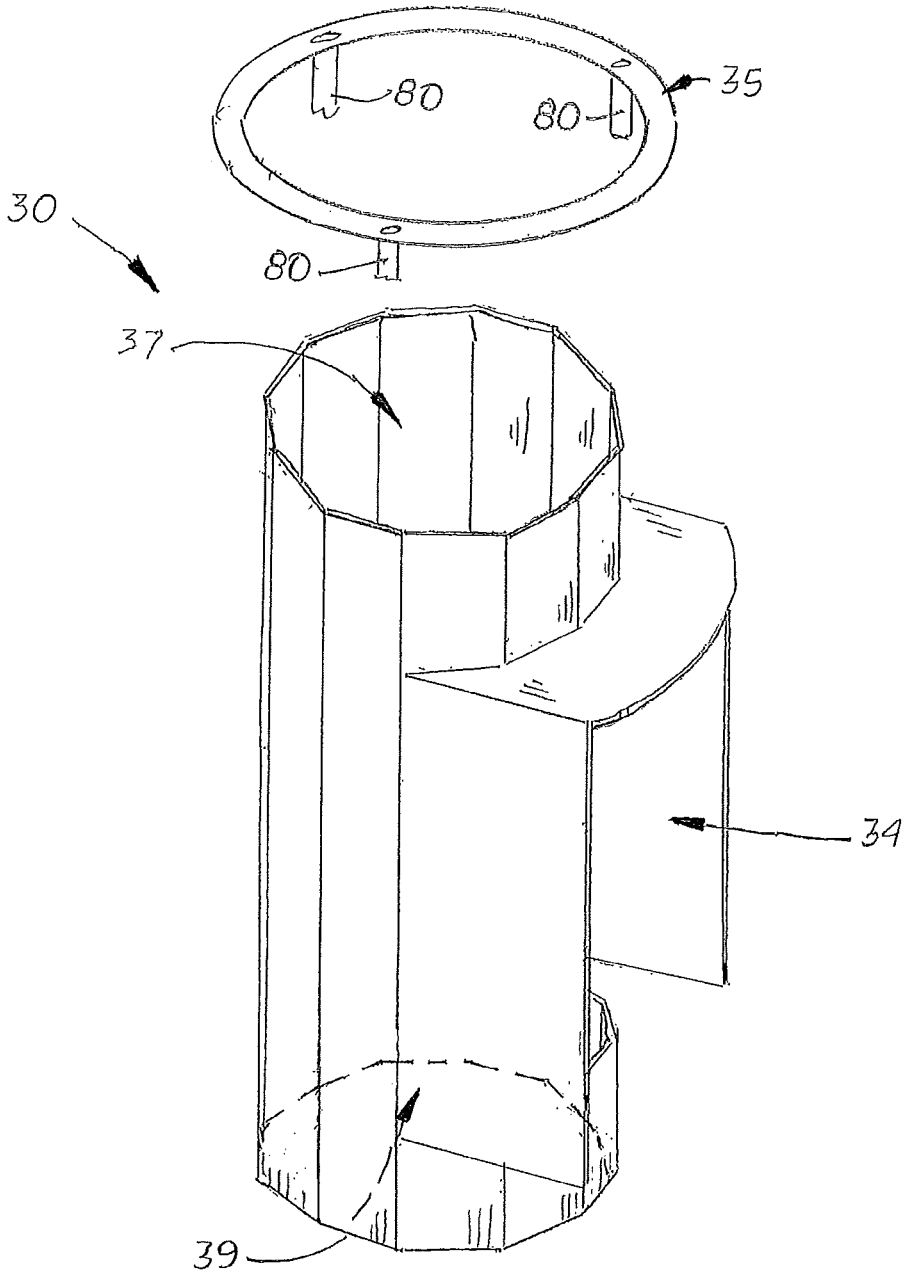
FIG. 6 is a perspective of the primary fire box.
Figure 7:
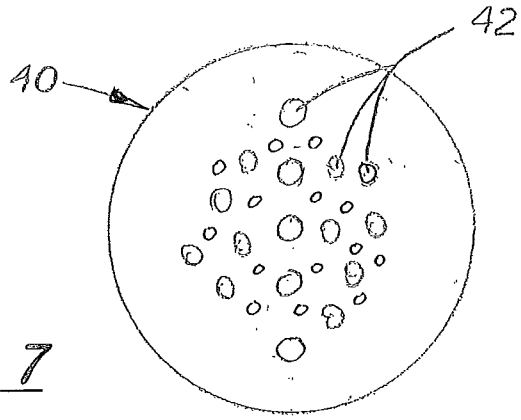
FIG. 7 is a top plan view of the perforated bottom plate located inside the primary fire box.

Located inside the outer skin 12 is a longitudinally aligned lower primary fire box 30 and an upper secondary fire box 100. The primary fire box 30 and the secondary fire box 100 are coaxially aligned inside the outer skin 12. The primary fire box 30 has a diameter slightly smaller than the outer skin 12 and extends approximately 50% of the length of the outer skin 12. An optional spacer 37 may be attached to the primary fire box 30 to hold it centrally inside the outer skin 12. Attached to the top edge of the primary fire box 30 is a flat ring 35 that forms an inward extending upper ledge 32. A gap is created between the inside wall of the outer skin 12 and the primary fire box 30 and the secondary fire box 100 filled with refractory insulation 99. As shown in FIG. 6, formed on the outer skin 12 and fire box 30 is a front opening 20 that extends into the primary chamber 34 located inside the primary fire box 30.

Attached to the outer skin 12 and located over the front opening 20 is a hinge mounted loading door 60.

Extending longitudinally inside the outer skin 12 and outside the primary fire box 30 are three air conduits 80. The air conduits 80 are spaced approximate 120 degrees apart. The lower ends of the air conduits 80 are in the air cavity and extend to the upper ledge 32. When using the wood stove 10, cool fresh air enters 5 the air conduits 80 and travels upward in the gap adjacent to the side walls of the primary fire box 30 where it is super heated to approx. 300 to 600 degrees F.

Figure 9:
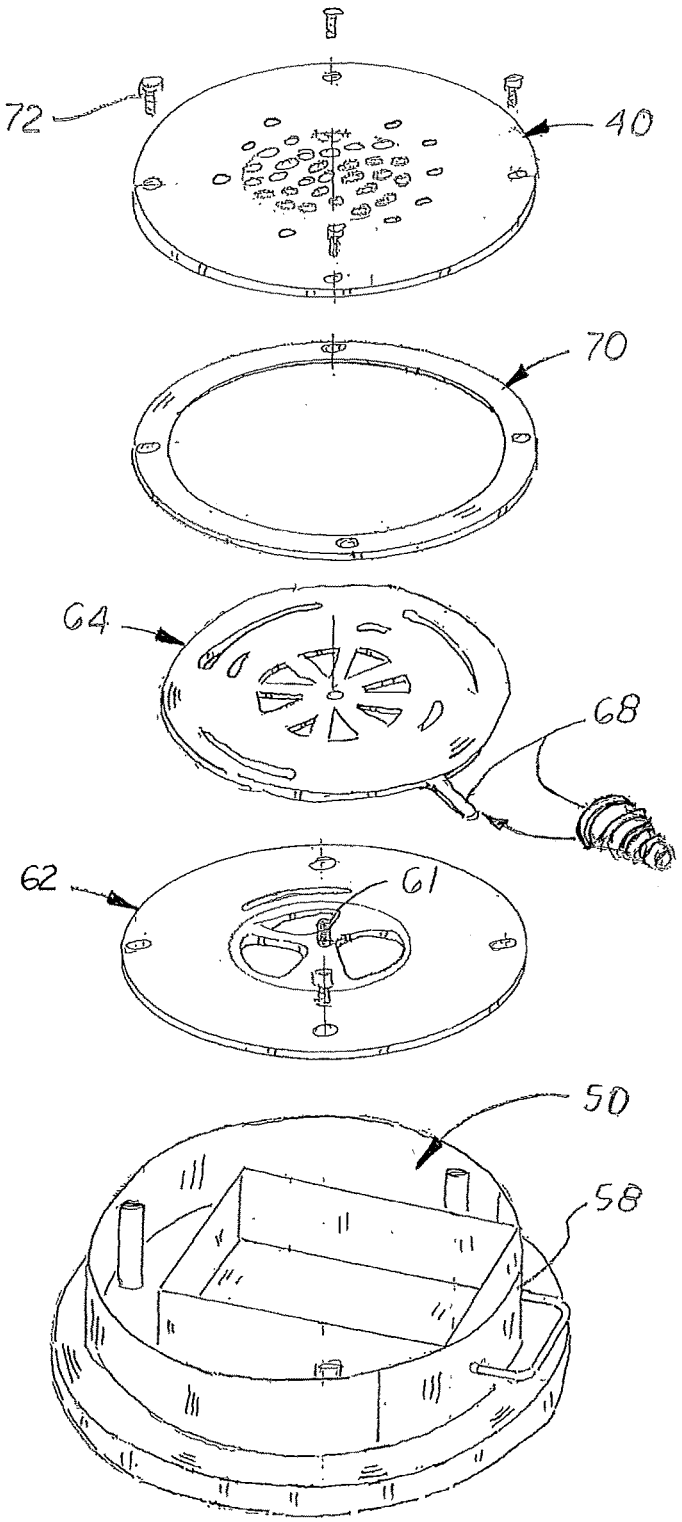
FIG. 9 is an exploded, perspective view of the adjustable air control assembly.

The primary fire box 30 includes a lower opening 39 with a perforated plate 40 with small air holes 42 formed therein. Located under the primary fire box 30 is an air cavity 50 with a removable ash dump tray 58. As shown in FIG. 9, attached over the air cavity 50 is a fixed air control cover plate 62. Mounted over the air control cover plate 62 is a rotating damper plate 64 with a laterally extending handle 68 attached thereon. The damper plate 64 is coaxially aligned inside an outer support ring 70. The damper plate 64 rotates inside the support ring 70. A pin 63 extends upward from the top surface of the air control cover 60 that enables the damper plate 64 to rotate. The support ring 70 attaches to the bottom surface of the perforated base plate 40 via threaded connectors 72.

Figure 8:
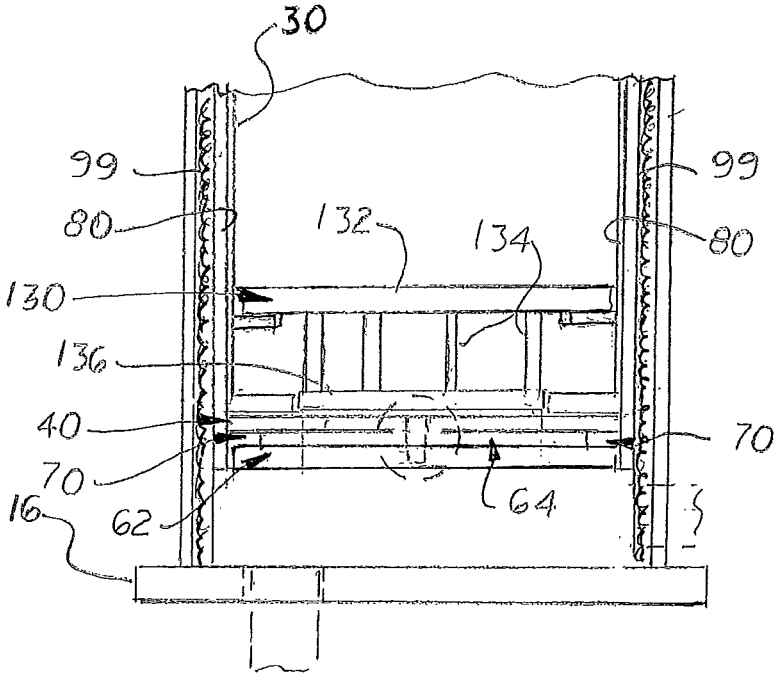
FIG. 8 is a partial side elevational view of the stove showing the ash dump grate and adjustable air control assembly.

As shown in FIG. 8, a grate ash dump cover 130 is placed over the perforated plate 40. The dump cover 130 includes an upper plate 132 and a lower plate 136 held apart with a plurality of legs 134. During operation, the dump cover 130 blocks upward flow of fresh air 5 from entering the primary chamber 34.

Figure 5:
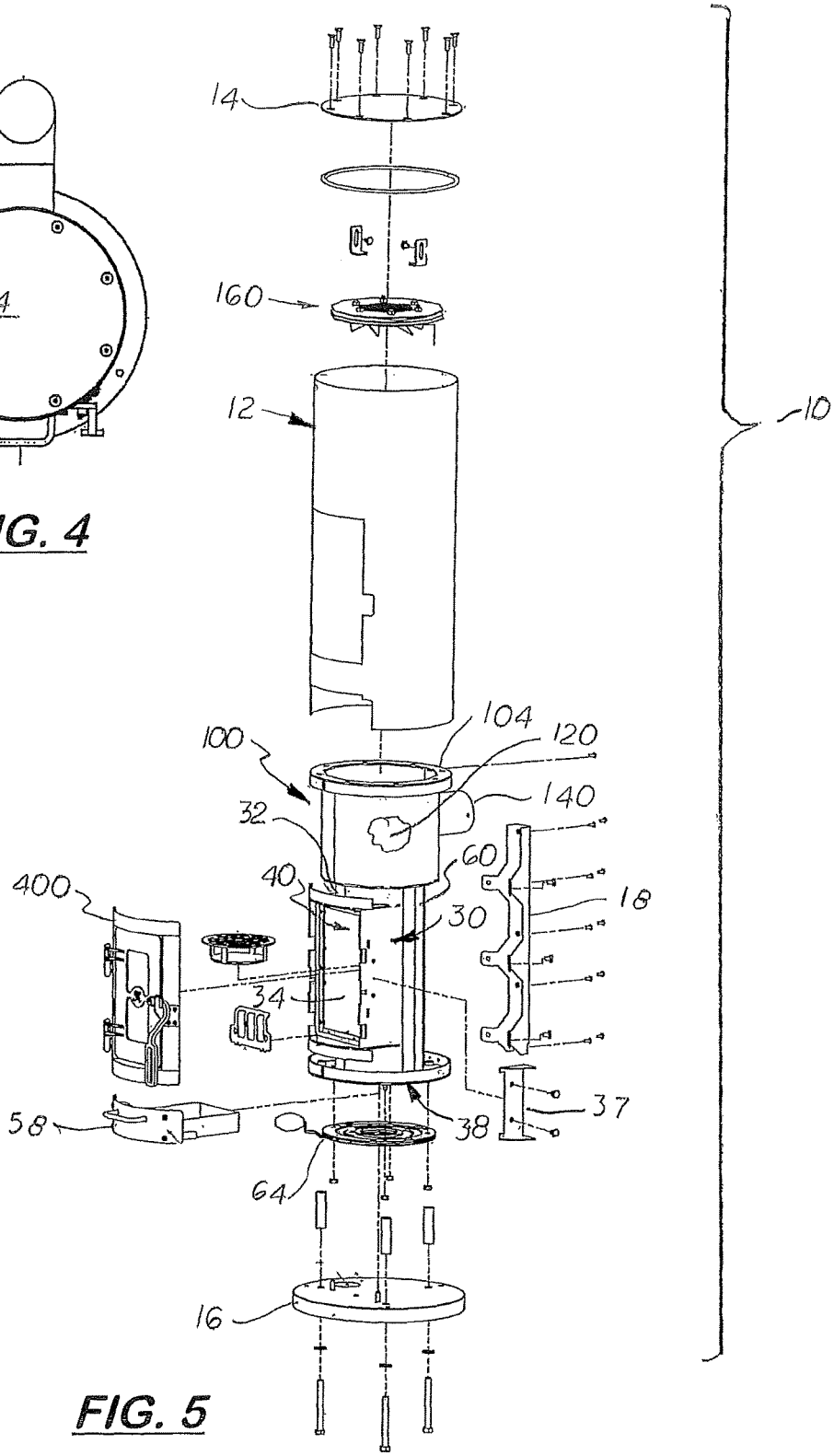
FIG. 5 is an exploded perspective view of the wood stove.
Figure 10:
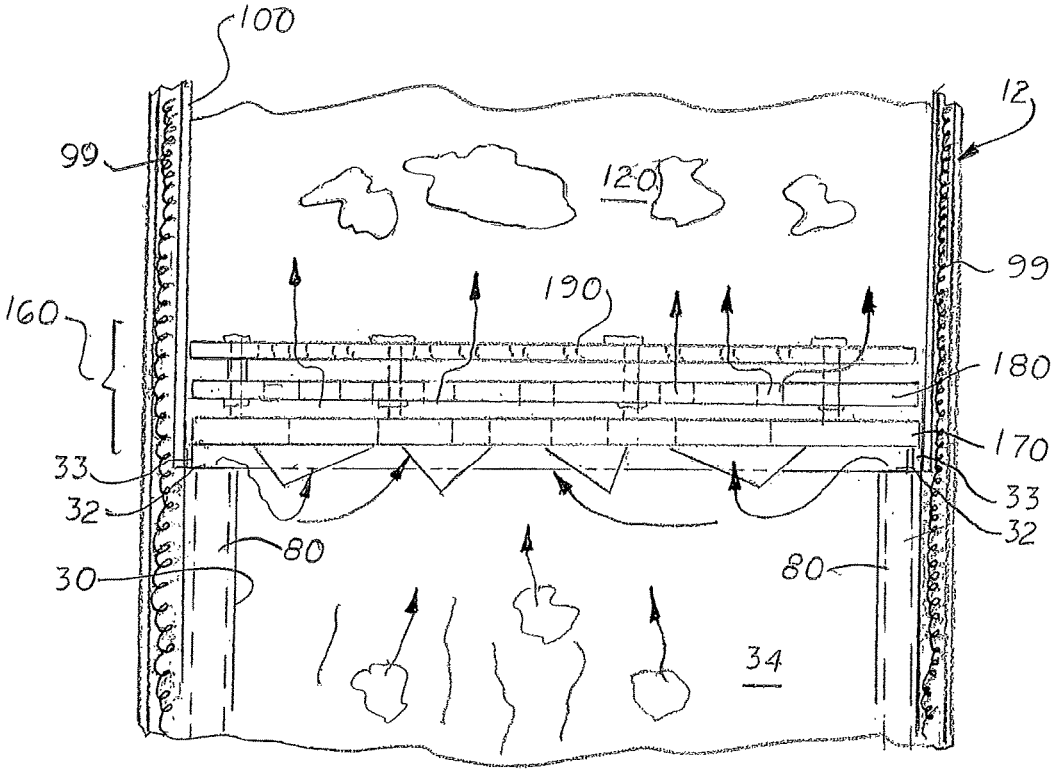
FIG. 10 is a partial sectional view of the stove showing the placement of the combustor assembly on the ledge located on the primary fire box and showing hot gases and fumes mixed with fresh air from the air conduits that flow through the combustor assembly and into the secondary chamber.
Figure 11:
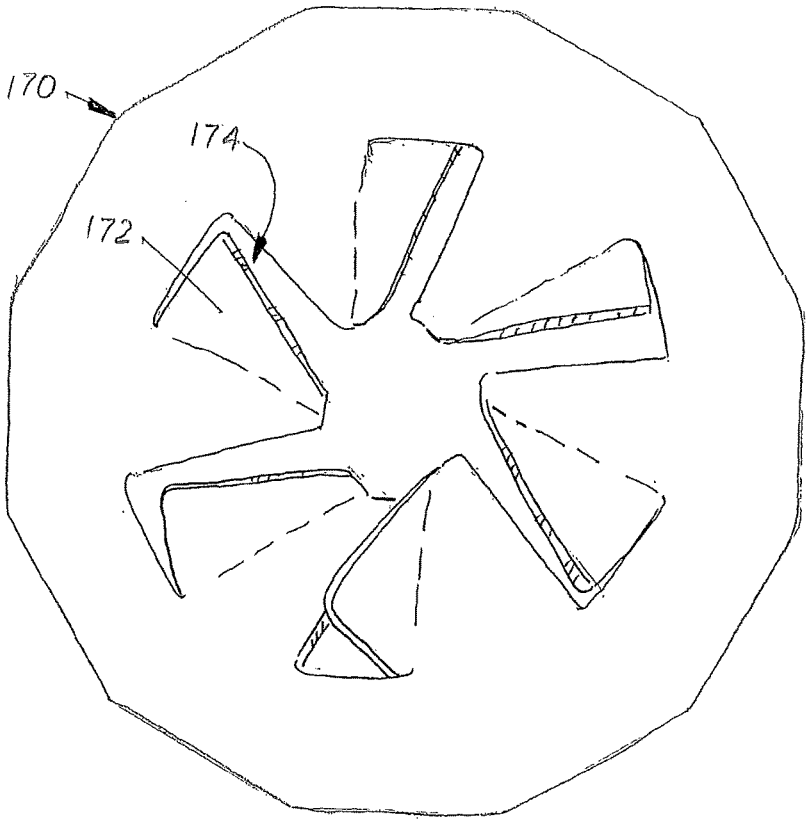
FIG. 11 is a bottom plan view of the fin plate used on the combustor assembly.

As shown in FIGS. 5 and 10, disposed above the primary fire box 30 is a cylindrical secondary fire box 100 with continuous bore 106 formed therein. Attached to the secondary fire box 100 is a flue collar 140. The secondary fire box 100 fits inside the outer skin 12 and is 1 to 2 inches greater in diameter than the primary fire box 30. The secondary fire box 100 includes a wide diameter top collar 104 welded to the top edge of the outer skin 12. Attached to the top collar 104 is a top plate 105.

Figure 12:
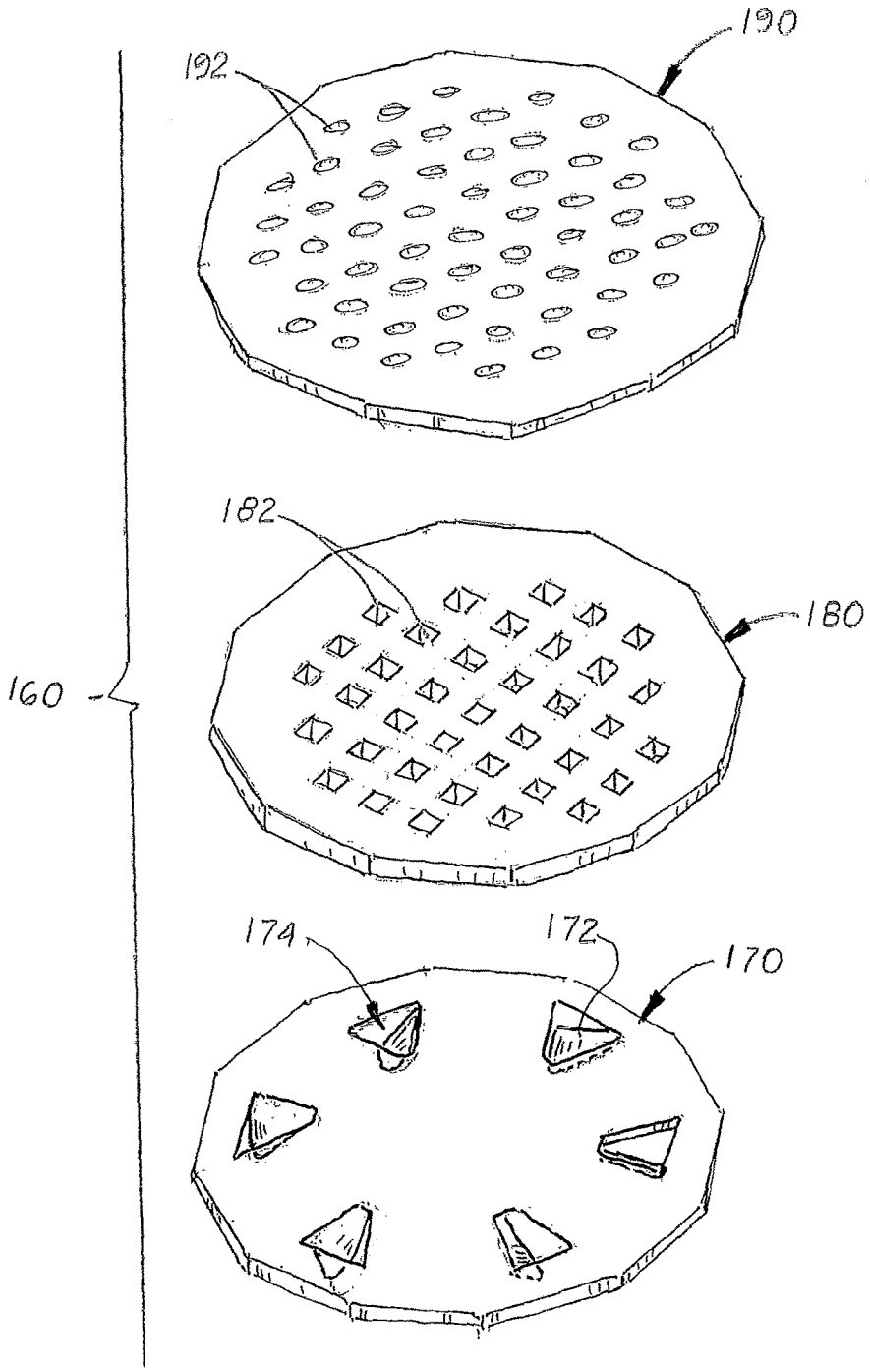
FIG. 12 is an exploded perspective view of the combustor assembly.

Disposed transversely inside the secondary fire box 100 and supported over the upper ledge 32 is a combustor assembly 160 configured to enhance mixing of fresh air 5 delivered from the air conduits 80 and hot gases from the primary chamber 34 inside the primary fire box 30 and partially impede the flow of fresh air and hot gases into the secondary chamber 120 located above the combustor assembly 160 and inside the secondary fire box 100. As shown in FIG. 12, the combustor assembly 160 includes a flat lower fin plate 170, a perforated intermediate plate 180 and a perforated upper plate 190. The fin plate 170 is positioned slightly above the upper ledge 32 by vertical legs 33. As shown in FIG. 1, the fin plate 170 includes a plurality of downward extending fins 172 and a plurality of triangular openings 174. The intermediate plate 180 and upper plate 190 are spaced apart and stacked above the fin plate 170 and includes a plurality off set bores 182, 192, respectively.

During operation, hot gases and fumes flow upward from the primary combustion chamber 34 and mix with super heated fresh air 5 released from the air conduits 80. The mixture of hot gases, fumes and super heated fresh air may combust or slowly flow through the combustor assembly 160 and into the secondary chamber 120 where secondary combustion may occur.

During operation, the user opens the door 400, installs fuel into the primary chamber 34, and opens the damper plate 64 to a first position to allow fresh air to enter the primary chamber 34. The fuel is then ignited. After a steady fire has been created in the primary chamber 34, the user may then move the damper plate 64 to the second position to equally distribute fresh air 5 to the primary chamber 34 and the secondary chamber 120. The user may move the damper plate 64 to the third position to reduce the flow of fresh air 5 to the primary chamber 34 and to maximize air flow into the air conduits 80 to the secondary chamber 120.

In the embodiment shown in the accompanying FIGS. 1-7, the stove 10 is approximately 26 inches in height and 10 inches in diameter. The reflective insulation 99 is approximately ¾ inches thick. The front opening 20 measures approximately 10 inches (H)×6 inches (W). The stove pipe 90 is approximately 3 inches in diameter. The primary fire box 30 measures approximately 6 inches in diameter and 10 inches in length. The secondary fire box 100 measures approximately 7 inches in diameter and approximately 12 inches in length.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A small, high efficiency wood stove, including:

a. a hollow cylindrical outer skin, said outer skin includes top opening and a lower opening;

b. a top plate mounted of said top opening of said outer skin;

c. a bottom base attached over said bottom opening of said outer skin;

d. a stove pipe opening formed on said outer skin near said top opening;

e. a longitudinally, coaxially aligned, hollow primary fire box located inside said outer skin, f. a longitudinally, coaxially aligned hollow secondary fire box located inside said outer skin and above said primary fire box, said secondary fire box configured to receive hot gases from said primary fire box;

g. an inward extending ledge located inside said outer skin and above said primary fire box;

h. a layer of insulation located between said outer skin and said primary fire box;

i. a lower air cavity formed inside said outer skin and below said primary fire box;

j. at least two longitudinally aligned air conduits extending from said lower air cavity to said ledge;

k. a combustor assembly located inside said outer skin and between said primary fire box and said secondary fire box, said combustor assembly configured to enhance mixing of fresh air delivered by said air conduits and hot gases from said primary fire box and partially impede the flow of fresh air and hot gases into a secondary combustion chamber located above said combustor assembly; and, l. an adjustable damper plate to control the flow of fresh air into said primary fire box and said secondary fire box.

2. The stove as recited in claim 1, wherein said outer skin is made of stainless steel.

3. The stove as recited in claim 1, further including a removable ash tray located under said primary fire box.

4. The stove as recited in claim 1, wherein said primary fire box includes a lower opening with a grate and ash pan cover disposed over said lower opening.

5. The stove as recited in claim 1, further including an ash pan located under said lower opening and under said grate and as pan cover.

6. The stove as recited in claim 1, further including a removable ash pan located under said lower opening.

7. The stove as recited in claim 1, further including a fresh air inlet port formed on said outer skin that communicates with said lower opening on said primary fire box.

8. The stove as recited in claim 1, further including a fresh air inlet port formed on said base that communicates with said lower opening on said primary fire box.

9. The stove as recited in claim 1, wherein said combustor assembly includes a lower fin plate with a plurality of downward extending fins and surrounding openings, an intermediate perforated plate, and an upper perforated plate.

* * * * *